US006626071B2

(12) United States Patent
Kesinger et al.

(10) Patent No.: US 6,626,071 B2
(45) Date of Patent: Sep. 30, 2003

(54) MULTI-FUNCTIONAL HAND TOOL ASSEMBLY WITH STORAGE HANDLE AND MULTIPLE TOOL ATTACHMENTS

(76) Inventors: Eric S. Kesinger, 468 S. Balsam St., Lakewood, CO (US) 80226; Donald A. Kesinger, 8206 S. Deer Creek Canyon Rd., Morrison, CO (US) 80465

( * ) Notice: Subject to any disclaimer, the term of this patent is extended or adjusted under 35 U.S.C. 154(b) by 307 days.

(21) Appl. No.: 09/801,279

(22) Filed: Mar. 7, 2001

(65) Prior Publication Data

US 2001/0035079 A1 Nov. 1, 2001

Related U.S. Application Data

(60) Provisional application No. 60/187,785, filed on Mar. 8, 2000.

(51) Int. Cl.[7] ..... B25F 1/04

(52) U.S. Cl. ..... 81/437; 81/438; 81/490; 81/177.6

(58) Field of Search ..... 81/437–440, 442, 81/467, 489, 490, 177.4, 177.85, 177.6, 177.7, 177.75

(56) References Cited

U.S. PATENT DOCUMENTS

| | | | | | |
|---|---|---|---|---|---|
| 1,416,461 | A | * | 5/1922 | Hance | 7/138 |
| 2,182,673 | A | | 12/1939 | Magnano | 145/61 |
| 2,476,762 | A | | 7/1949 | Petre et al. | 279/96 |
| 3,114,401 | A | * | 12/1963 | Johnson | 81/438 |
| 4,096,896 | A | | 6/1978 | Engel | 145/50 B |
| 4,848,197 | A | * | 7/1989 | Kikel | 81/440 |
| 5,048,379 | A | | 9/1991 | Gramera et al. | 81/124.4 |
| 5,186,083 | A | | 2/1993 | Hsiao | 81/124.4 |
| 5,341,705 | A | | 8/1994 | Lin | 81/438 |
| 5,450,775 | A | * | 9/1995 | Kozak | 81/440 |
| 5,579,668 | A | | 12/1996 | Kozak | 81/439 |
| 5,606,758 | A | * | 3/1997 | Tung | 7/138 |
| 5,904,080 | A | * | 5/1999 | Anderson et al. | 81/439 |
| 6,016,728 | A | * | 1/2000 | Bohl | 81/437 |
| 6,076,432 | A | * | 6/2000 | Chang | 81/61 |
| 6,151,994 | A | * | 11/2000 | Shiao | 81/61 |
| 6,305,255 | B1 | * | 10/2001 | Wu | 81/439 |

FOREIGN PATENT DOCUMENTS

| | | |
|---|---|---|
| FR | 615006 | 12/1926 |
| GB | 403769 | 1/1934 |

OTHER PUBLICATIONS

McMaster–Carr Catalog, p. 2132, "Torque Screwdrivers".
McMaster–Carr Catalog, p. 1926, "Four–Way Nut Drivers".
Utica Catalog, p. 1444, "Torque Limiting Screwdrivers".

* cited by examiner

*Primary Examiner*—Joseph J. Hail, III
*Assistant Examiner*—David B. Thomas
(74) *Attorney, Agent, or Firm*—Flanagan & Flanagan; John R. Flanagan

(57) ABSTRACT

A multi-functional hand tool assembly includes a handle with tool attachments. The handle has opposite ends with opposite holes extending therethrough. The tool attachments are removably, interchangeably and reversibly insertable into the handle ends and each has a middle section and end tool sections connected to and extending in opposite directions from opposite ends of the middle section. Each middle section is identical to one another and has a continuous exterior surface which matches a continuous interior end surface defining each hole in a handle end such that the middle sections can snugly fit through the hole in either handle end so as to mount the tool attachments in non-rotatable relationships with the handle ends such that the tool attachments will turn with turning of the handle.

12 Claims, 4 Drawing Sheets

MULTI-FUNCTIONAL HAND TOOL ASSEMBLY WITH STORAGE HANDLE AND MULTIPLE TOOL ATTACHMENTS

This utility patent application claims the benefit of provisional application No. 60/187,785 filed Mar. 8, 2000.

BACKGROUND OF THE INVENTION

1. Field of the Invention

The present invention generally relates to a multiple functional hand tools and, more particularly, is concerned with a multi-functional hand tool assembly with storage handle and multiple tool attachments.

2. Description of the Prior Art

Various hand tools are known in the prior art to perform a variety of functions. In particular, U.S. Pat. No. 2,476,762 to Petre et al and U.S. Pat. No. 3,114,401 to Johnson disclose a hand tool which includes a handle and a screwdriver shank with different opposite tip configurations reversibly receivable in a sleeve in the handle. Also, the Johnson patent and U.K. Pat. No. 403,769 to Hibbard disclose a four-way hand tool which includes two pairs of tool attachments each fitting one of the opposite ends of a handle of the tool. Each pair of tool attachments of the Johnson and Hibbard hand tools are a pair of reversible sockets of different sizes which fit into holes of different sizes in opposite ends of a handle. In addition, torque limiting screwdrivers and ratchet wrenches having various constructions are known in the prior art.

A problem exists, however, with prior art hand tools in that each hand tool has its own particular construction which includes a handle for gripping and manipulating the tool in performing its particular function. The handle typically is the largest part of the tool and thus takes up the most storage space. Service personnel who need to have a variety of hand tools with them must incur the added expense of multiple tools with multiple handles and of larger storage containers to provide the extra space for the multiple tools and their handles.

SUMMARY OF THE INVENTION

The present invention overcomes the aforementioned drawbacks by providing a multi-functional hand tool assembly with a common storage handle and multiple tool attachments accommodated by the handle so as to obviate the aforementioned problems with prior art designs.

Accordingly, the present invention is directed to a multi-functional hand tool assembly which comprises: (a) an elongated handle having opposite ends and a pair of opposite holes each extending into one of the opposite ends of the handle, the opposite holes being defined by substantially identical non-circular continuous interior end surfaces formed in the opposite ends of the handle; and (b) a plurality of tool attachments being removably, interchangeably and reversibly insertable into the opposite ends of the handle, each of the tool attachments having a middle section and opposite end tool sections connected to and extending in opposite directions from the middle section, the middle sections being substantially identical to one another and each having a non-circular continuous exterior surface which matches the non-circular continuous interior end surface defining each of the holes in the opposite ends of the handle such that the middle section of each of the tool attachments is slightly smaller in cross-sectional size than each of the holes so that the middle section of each of the tool attachments can snugly fit through either of the holes in the opposite ends of the handle so as to mount the tool attachments in non-rotatable relationships with the opposite ends of the handle such that the tool attachments will turn with turning of the handle. The handle also has an interior storage chamber defined therein extending between the opposite ends thereof. Each of the opposite holes in one of the opposite ends of the handle leading into the storage chamber. The middle section of at least one of the tool attachments has first and second parts pivotally articulated to each other.

The present invention also is directed to a multifunctional hand tool assembly which comprises: (a) an elongated handle including a pair of handle segments each having a pair of opposite ends and a pair of opposite holes each extending into respective outer and inner ones of the opposite ends of each of the handle segments, the opposite holes being defined by continuous interior end surfaces formed in the opposite ends of the respective handle segment; (b) a plurality of tool attachments being removably insertable into the outer ones of the opposite ends of each of the handle segments, each of the tool attachments having a continuous exterior surface which matches the continuous interior end surface defining each of the holes in the outer ones of the opposite ends of each of the handle segments such that each of the tool attachments is slightly smaller in cross-sectional size than each of the holes in the outer ends of each of the handle segments so that each of the tool attachments can snugly fit through one of the holes so as to mount the tool attachments in non-rotatable relationships therewith such that the tool attachments will turn with turning of the handle; and (c) a central interconnector tool attachment having a pair of opposite ends, at least one of the opposite ends being adapted to removably interfit with one of the holes in the inner ends of the handle segments and thereby interconnect and retain the handle segments together.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2:
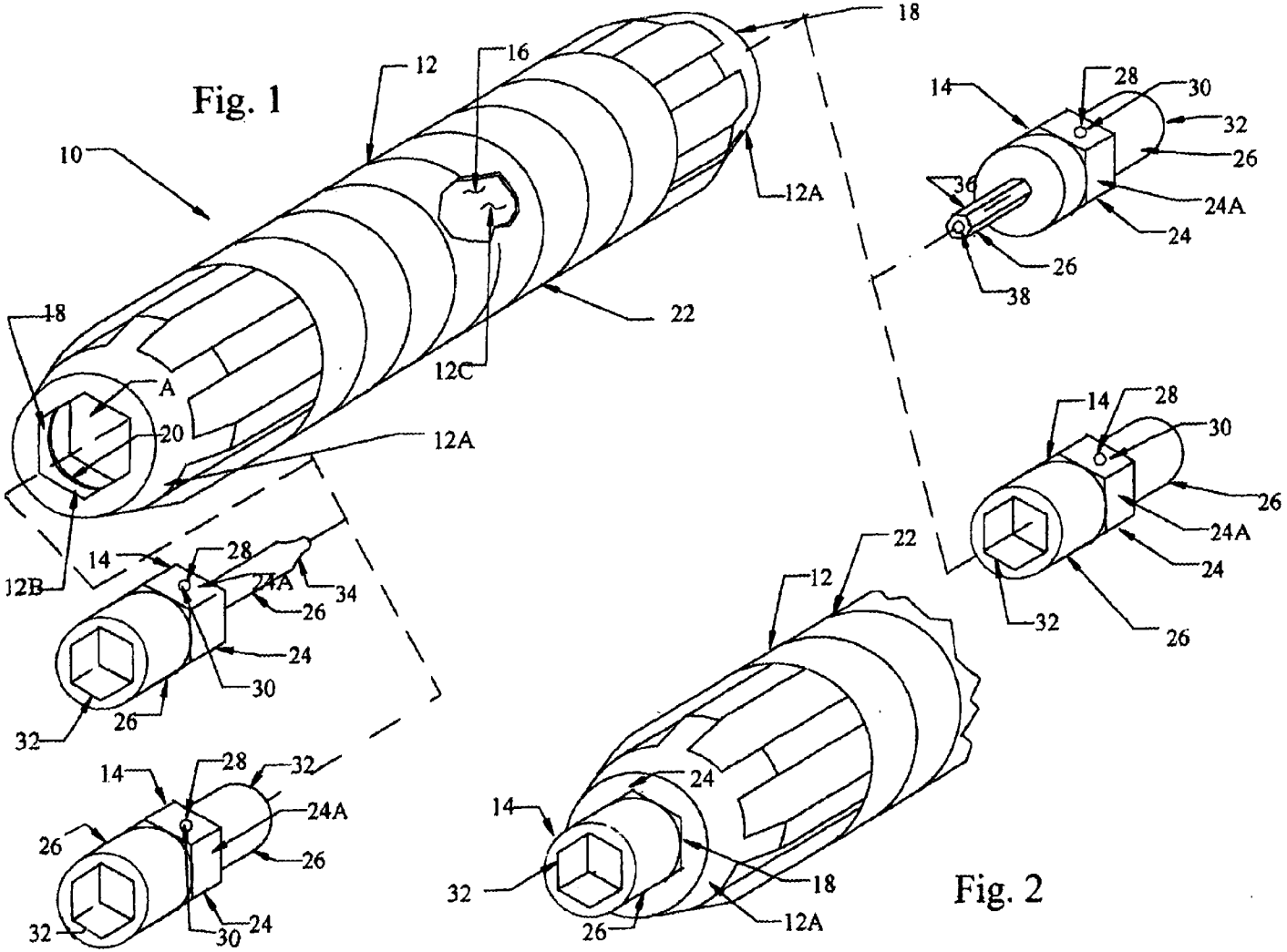
FIG. 1 is an exploded perspective view of a first embodiment of a multi-functional hand tool assembly of the present invention having a handle and a plurality of tool attachments removably and reversibly insertable into opposite ends of the handle.
FIG. 2 is a fragmentary perspective view of the handle of the tool assembly of FIG. 1 with one of the tool attachments inserted at one end of the handle.

Referring to the drawings and particularly to FIGS. 1 to 4, there is illustrated a multi-functional hand tool assembly, generally designated 10, of the present invention. The hand tool assembly 10 basically includes an elongated handle 12, made of a suitable material such as a metal or plastic, and a plurality of tool attachments 14, made of a suitable material such as a metal, being interchangeably, removably and reversibly insertable in the opposite ends 12A of the handle 12. The handle 12 has a generally cylindrical configuration and can define an interior storage chamber 16 extending between the opposite ends 12A. The handle 12 also has a pair of opposite holes 18 extending through the opposite ends 12A of said handle. Where the handle 12 has the interior storage chamber 16, the opposite holes 18 can lead into the storage chamber 16. Preferably, the storage chamber 16 does not extend uninterrupted between the opposite ends 12A of the handle 12. Instead, the storage chamber 16 is separated into two back-to-back compartments by a transverse wall 12C extending across the chamber 16 at the middle of the handle 12. The holes 18 are defined by substantially identical, non-circular, and preferably hexagonal-shaped, continuous interior end surfaces 12B formed at the opposite ends 12A of the handle 12. Each interior end surface 12B has a continuous detent in the form of a groove 20 formed therein. The interior end surface 12B and groove 20 at each end 12A of the handle 12 extend symmetrically about a central longitudinal axis A of the handle 12. The handle 12 also has an external annular hand grip 22 for gripping by a user to turn the handle 12 about its central longitudinal axis A.

Each tool attachment 14 has a middle section 24 and opposite end tool sections 26 connected to and merging from the opposite ends of the middle section 24 and extending in opposite directions therefrom. The middle sections 24 of the tool attachments 14 have substantially identical non-circular, and preferably hexagonal-shaped, continuous exterior surfaces 24A which match the non-circular continuous interior end surfaces 12B defining the holes 18 in the opposite ends 12A of the handle 12 such that the middle sections 24 of the tool attachments 14 are slightly smaller in cross-sectional size than the holes 18 so that the middle sections 24 can snugly fit through either of the holes 18.

Each middle section 24 has a detent in the form of a ball 28 of a shape complementary to that of the groove 20 and yieldably seated in a recess 30 in the exterior surface 24A thereon such that the ball 28 is spring-biased to protrude beyond the exterior surface 24A but is retractable into the recess 30 upon application of an external force on the ball 28. When the middle section 24 of the tool attachment 14 is inserted through one of the holes 18, the ball 28 will snap fit in the groove 20 so as to releasably retain the tool attachment 14 mounted in the respective end 12A of the handle 12 in a non-rotatable fixed relationship with the handle 12, as seen in FIG. 2, such that the tool attachment 14 will turn with the turning of the handle 12 by a user about the longitudinal axis A. The spring bias force of the ball 28 can be easily overcome and the tool attachment 14 removed from the respective end 12A of the handle 12 by gripping the exposed end tool section 26 and applying a small amount of axially-directed pulling force thereon.

The opposite end tool sections 26 of the tool attachments 14 of FIG. 1 can take various forms. For instance as shown in FIG. 1, the various tool sections 26 can be wrench sockets 32 of different sizes, such as ½, ⅜, 7/16 and ¼ inch, a screwdriver straight blade 34 or a hex wrench 36 with a security pin hole 38.

Figure 3:
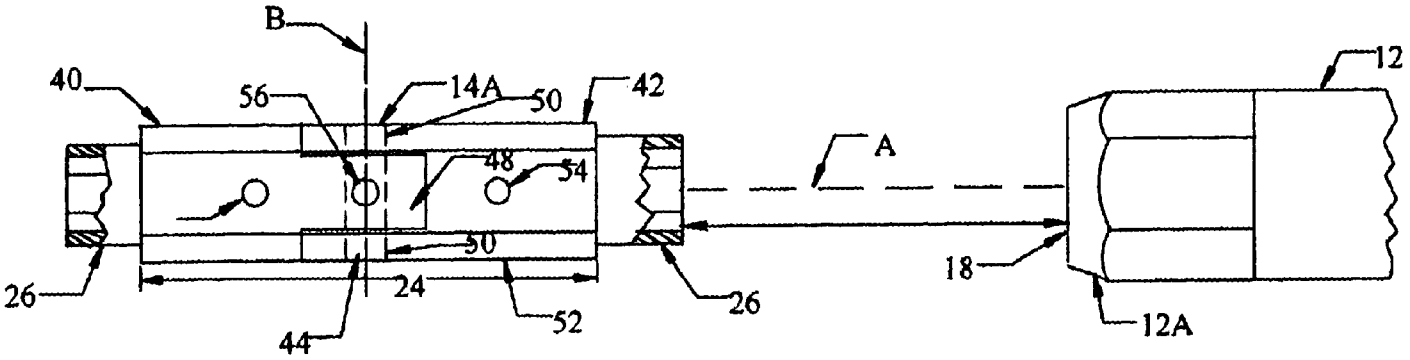
FIG. 3 is a fragmentary side elevational view of the handle of the tool assembly of FIG. 1 but having an articulated tool attachment with both pivotal parts of the articulated tool attachment shown in axial alignment with the handle and with one another.
Figure 4:
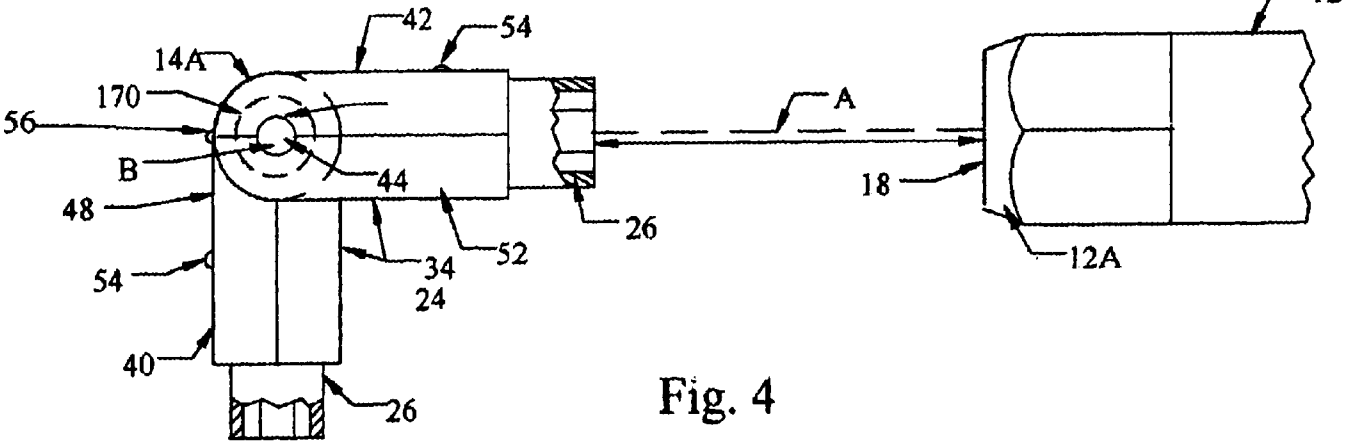
FIG. 4 is another fragmentary side elevational view of the handle similar to that of FIG. 3 but with one pivotal part of the articulated tool attachment shown in axial alignment with the handle and with the other pivotal part of the articulated tool attachment pivoted ninety degrees relative to the one pivotal part and the handle.

The tool attachment 14A of FIGS. 3 and 4 also has a middle section 24 and a pair of opposite end tool sections 26. However, here, the middle section 24 of the tool attachment 14A is an articulated component being comprised of two parts 40, 42 pivotally connected to each other by a pin 44 extending through a hole 46 in a tongue end structure 48 on the one part 40 and a pair of holes 50 in a bifurcated end structure 52 on the other part 42. The tongue end structure 48 is received within the bifurcated end structure 52 and retained therein by the pin 44 but pivotally movable relative thereto about an axis B defined by the pin 44 that extends in a transverse relationship to the longitudinal axis A of the handle 12. The opposite end tool sections 26 are sockets of different sizes. The tool attachment 14A when inserted up to either of its two articulated parts 40, 42 into the hole 18 at one of the ends 12A of the handle 12 can function as an articulated or pivotal tool element if either of a pair of outer two detents in the form of spring-biased balls 54 are snap fitted in the groove (not shown) in the hole 18 at the handle end 12A or can function as a straight tool element if a middle detent in the form of a spring-biased ball 56 on the tongue end structure 48 is snap fitted in the groove.

Figures 5, 6:
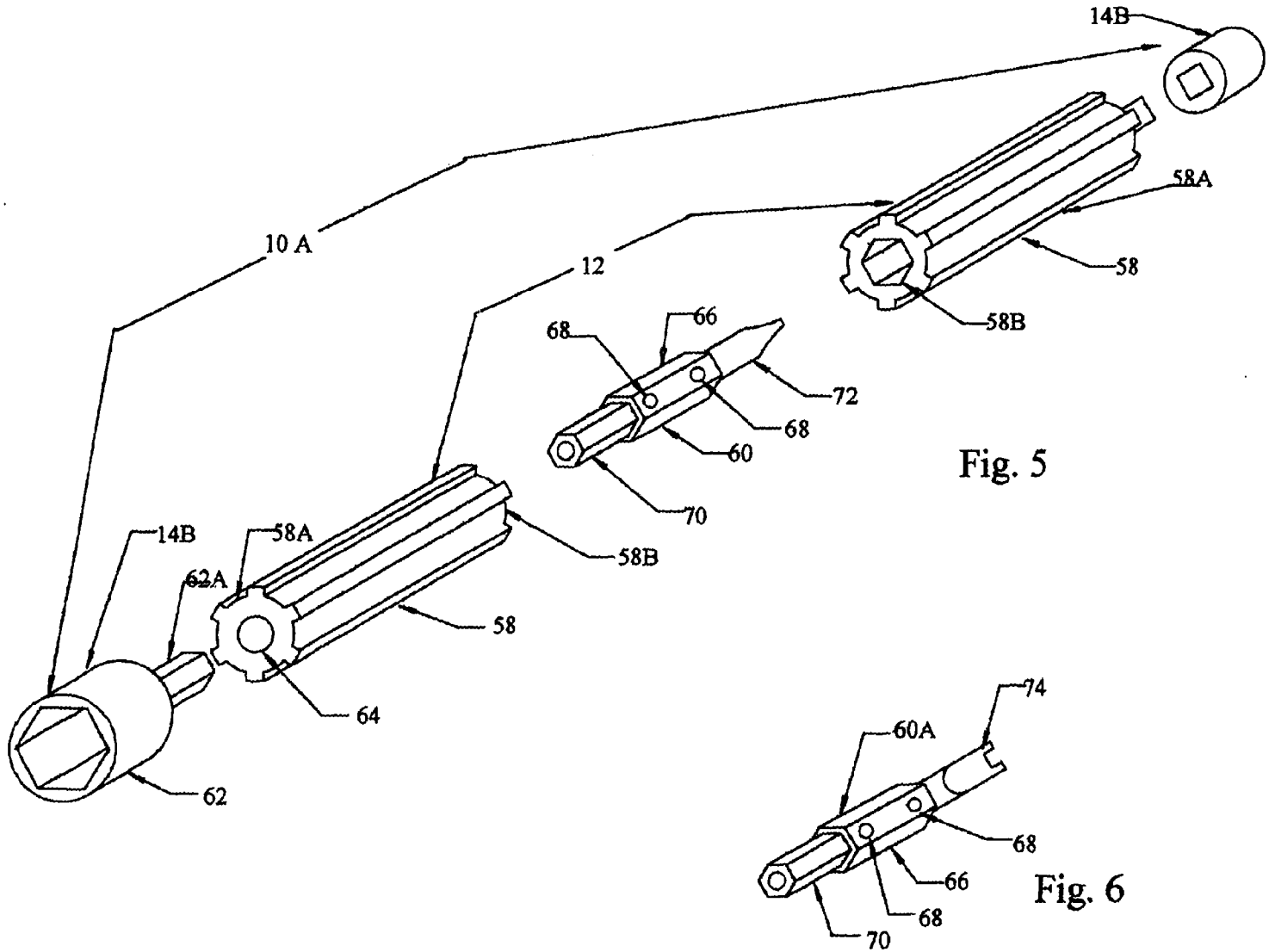
FIG. 5 is an exploded perspective view of a second embodiment of the hand tool assembly of the present invention similar overall to the first embodiment of the assembly shown in FIG. 1 except now having a handle comprised of two segments and an interconnector tool attachment adapted to removably interconnect and retain the two segments of the handle together.
FIG. 6 is a perspective view of a modified form of the interconnector tool attachment of FIG. 5.

Referring to FIGS. 5 and 6, there is shown a second embodiment of the hand tool assembly of the present invention, generally designated 10A. The hand tool assembly 10A has a construction generally similar overall to that of the hand tool assembly 10 of FIG. 1 except for the following differences. In the second embodiment of the assembly 10A, the handle 12 includes two annular segments 58 which can be substantially identical to one another, only single socketed tool attachments 14B are provided for attaching to the outer ends 58A of the annular handle segments 58, and a double detented central interconnector tool attachment 60 is used to removably interconnect and retain the handle segments 58 together. The left tool attachment 14B is a special socket 62 having a non-circular extension 62A which presses into a round hole 64 in the outer end 58A of the left handle segment 58. Alternatively, the extension 62A could be made round with an annular knurled portion (not shown) and fit into the round hole 64. The right tool attachment 14B has a standard socket configuration. The central interconnector tool attachment 60 has a middle section 66 which slip fits with the inner ends 58B of the handle segments 58. The middle section 66 has two spaced apart spring-biased detent balls 68 which may removably snap fit into complementary detent grooves (not shown) in the inner ends 58B of the handle segments 58. As seen in FIG. 5, the central interconnector tool attachment 60 also has tool elements, such as a hex socket security head 70 and a straight screwdriver bit 72 attached to and extending axially from the opposite ends of the middle section 66. In a modified central interconnector tool attachment 60A as shown in FIG. 6, a punchdown tool element 74 is provided instead of the screwdriver bit 72 as shown in FIG. 5.

Figure 7:
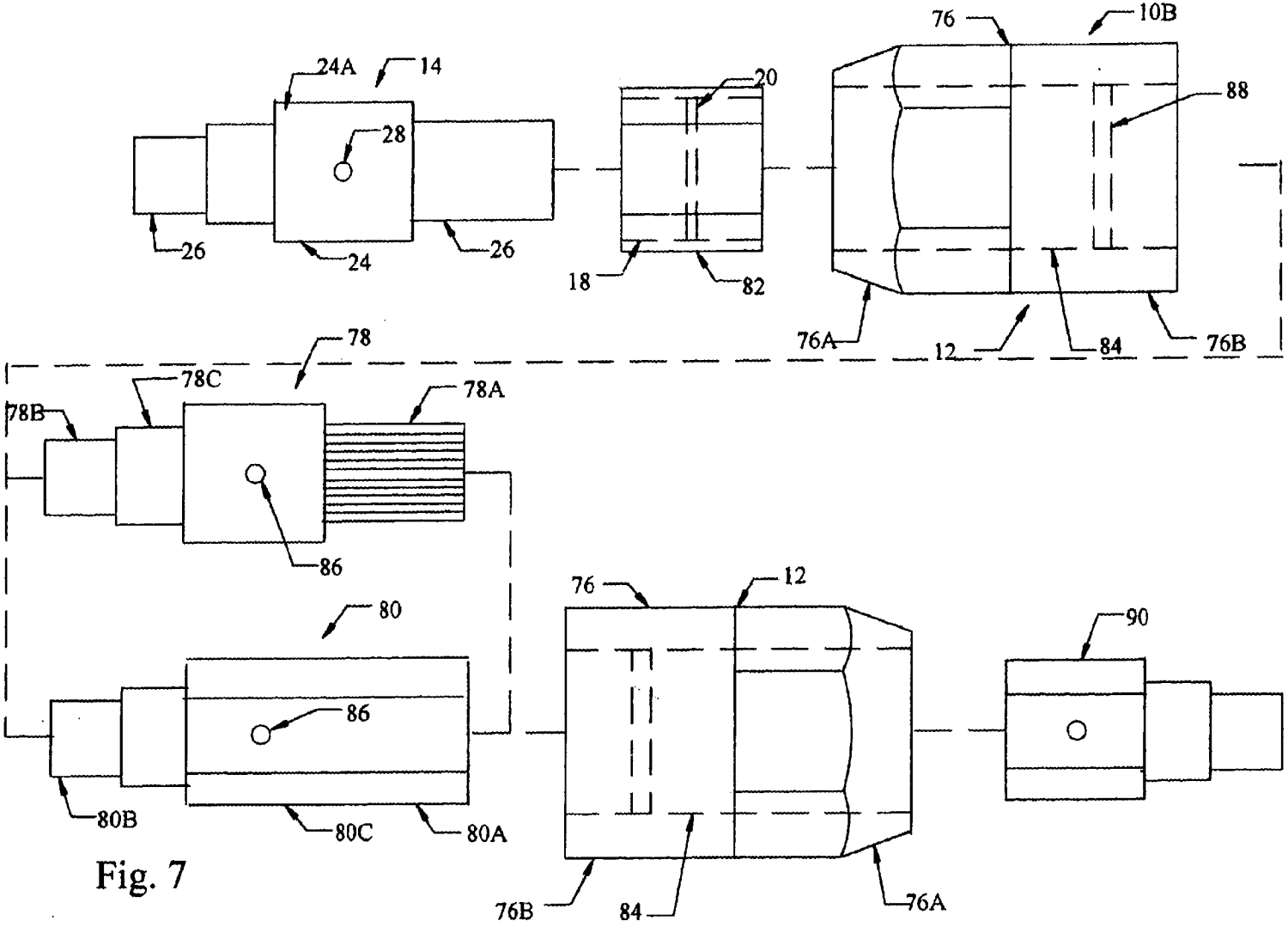
FIG. 7 is an exploded side elevational view of a third embodiment of the hand tool assembly of the present invention similar overall to the first embodiment of the assembly shown in FIG. 5 except now having a handle comprised of two segments and either one of two tool attachments permanently press-fit into one of the handle segments and removably received by the other handle segment.

Referring to FIG. 7, there is shown a third embodiment of the hand tool assembly of the present invention, generally designated 10C. The hand tool assembly 10C has a construction generally similar overall to that of the hand tool assembly 10A of FIG. 1, except for the following differences. In the third embodiment of the assembly 10B, the handle 12 includes two annular segments 76 which can be substantially identical to one another, either one of two alternative designs of additional tool attachments 78, 80 which is disposed between and interconnects the two handle segments 76, and a rigid annular insert sleeve 82 which is press-fitted into a central bore 84 of the left one of the handle segments 76 from the outer end 76A thereof. The sleeve 82 defines the opening 18 and the detent groove 20 at the outer end 76A of the left handle segment 76 for removably and interchangeably receiving therein the middle section 24 of a tool attachment 14 and the detent ball 28 thereon which snap fits into the groove 20. The two alternative designs of tool attachments 78, 80 have right end portions 78A, 80A of non-circular cross-sectional configuration adapted to be substantially permanently press-fitted into the central bore 84 of a right one of the handle segments 76 from the inner end 76B thereof. The tool attachments 78, 80 also have respective left end portions 78B, 80B defined as a given socket end section adapted to be removably received in the central bore 84 of the left one of the handle segments 76 from the inner end 76B thereof. The tool attachments 78, 80 further have respective middle portions 78C, 80C disposed between and integrally connecting the right and left end portions 76A, 80A and 76B, 80B with one another. The middle portions 78C, 80C have detent balls 86 thereon which snap fit into the retaining groove 88 in the bore 84 of the left one of the handle segments 76 allowing the tool attachments 78, 80 to be removed therefrom. Thus, the hand tool assembly 10B provides an additional, tool attachment 78 or 80 permanently mounted to the inner end 76B of one of the handle segments 76 which is stored within the other of the handle segments 76 when not in use and functions to retain the handle segments 76 together as the single handle 12. Also, the hand tool assembly 10B has a tool attachment 90 substantially permanently press-fitted into the central bore 84 of the right one of the handle segments 76 from the outer end 76A thereof.

In the articulate embodiment of FIGS. 3 and 4, there is a spring washer 170 incorporated at the hinge point to maintain the position of the articulated parts once they have been pivoted relative to one another.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A multi-functional hand tool assembly, comprising:

(a) an elongated handle having opposite ends and a pair of opposite holes each extending into one of said opposite ends of said handle, said opposite holes being defined by substantially identical non-circular continuous interior end surfaces formed in said opposite ends of said handle; and (b) a plurality of tool attachments being removably, interchangeably and reversibly insertable into said opposite ends of said handle, each of said tool attachments having a middle section and opposite end tool sections connected to and extending in opposite directions from opposite ends of said middle section, said middle section of each of said tool attachments being Substantially identical with one another and having a non-circular continuous exterior surface which matches said non-circular continuous interior end surface defining each of said holes in said opposite ends of said handle such that said middle section of each of said tool attachments is slightly smaller in cross-sectional size than each of said holes so that said middle section of each of said tool attachments can snugly fit through said holes in either of said opposite ends of said handle so as to mount said tool attachments in non-rotatable relationships with said opposite ends of said handle such that said tool attachments will turn with turning of said handle;

(c) said middle section of at least one of said plurality of tool attachments having first and second parts pivotally articulated to each other, said at least one tool attachment being insertable past either of said two articulated parts thereof into either of said holes in said opposite ends of said handle such that said one tool attachment can function as a straight tool element.

2. The assembly of claim 1 wherein said handle has a generally cylindrical configuration.

3. The assembly of claim 1 wherein said handle has an interior storage chamber defined therein extending between said opposite ends thereof, each of said opposite holes in said one of said opposite ends of said handle leading into said storage chamber.

4. The assembly of claim 3 wherein said storage chamber is separated into two back-to-back compartments by a wall extending across said storage chamber at a location intermediately between said opposite ends of said handle.

5. The assembly of claim 1 wherein each of said interior end surfaces has a first detent thereon.

6. The assembly of claim 5 wherein said middle section of each of said tool attachments has a second detent thereon complementary to said first detent on said interior end surface on each of said opposite ends of said handle such that upon insertion of each of said middle sections of said tool attachments through either of said holes in said opposite ends of said handle said first and second detents will mate with one another so as to releasably retain said tool attachments mounted in said non-rotatable fixed relationships with said opposite ends of said handle.

7. The assembly of claim 1 wherein said opposite end tool sections of said at least one tool attachment having said articulated middle section are sockets of different sizes.

8. The assembly of claim 1 wherein said at least one tool attachment is insertable up to either of said two articulated parts thereof into either of said holes in said opposite ends of said handle such that said one tool attachment can function as an articulated tool element.

9. A multi-functional hand tool assembly, comprising:

(a) an elongated handle including a pair of handle segments each having a pair of opposite ends and a pair of opposite holes each extending into respective outer and inner ones of said opposite ends of each of said handle segments, said opposite holes being defined by continuous interior end surfaces formed in said opposite ends of said handle segments; and (b) a plurality of tool attachments being removably insertable into said outer ones of said opposite ends of each of said handle segments, each of said tool attachments having a continuous exterior surface which matches said continuous interior end surface defining each of said holes in said outer ones of said opposite ends of each of said handle segments such that each of said tool attachments is slightly smaller in cross-sectional size than each of said holes in said outer ends of each of said handle that each of said tool attachments can snugly fit through one of said holes so as to mount said tool attachments in non-rotatable relationships therewith such that said tool attachments will turn with turning of said handle; and (c) a central interconnector tool attachment having a pair of opposite ends, at least one of said opposite ends being adapted to removably interfit with one of said holes in said inner ends of said handle segments and thereby interconnect and retain said handle segments together;

(d) both of said opposite ends being adapted to removably interfit with respective ones of said holes in said inner ends of said handle segments.

10. The assembly of claim 9, wherein said central interconnector tool attachment has a middle section which slip fits with said inner ends of said handle segments.

11. The assembly of claim 10 wherein said middle section has two spaced apart first detents.

12. The assembly of claim 11 wherein said inner ends of said handle segments have second detents complementary to said first detents and which can removably mate with said first detents in said inner ends of said handle segments so as to releasably retain said central interconnector tool attachment mounted in paid non-rotatable fixed relationships with aid inner ends of said handle segments.

* * * * *